US006680085B2

(12) United States Patent
Kley

(10) Patent No.: US 6,680,085 B2
(45) Date of Patent: Jan. 20, 2004

(54) METHOD AND DEVICE FOR THERMAL SPRAYING FOR THE COATING OF SURFACES

(75) Inventor: Dieter Kley, Castrop-Rauxel (DE)

(73) Assignee: Grillo-Werke AG, Duisburg (DE)

( * ) Notice: Subject to any disclaimer, the term of this patent is extended or adjusted under 35 U.S.C. 154(b) by 0 days.

(21) Appl. No.: 10/338,734

(22) Filed: Jan. 9, 2003

(65) Prior Publication Data

US 2003/0099779 A1 May 29, 2003

Related U.S. Application Data

(63) Continuation of application No. 09/807,979, filed as application No. PCT/EP99/08247 on Oct. 29, 1999, now abandoned.

(30) Foreign Application Priority Data

Oct. 31, 1998 (DE) ..... 298 19 453 U

(51) Int. Cl.[7] ..... C23C 4/12; B05C 5/04

(52) U.S. Cl. ..... 427/449; 427/446; 219/76.16; 239/83

(58) Field of Search ..... 427/449, 446, 427/455, 456; 219/76.16; 239/83

(56) References Cited

U.S. PATENT DOCUMENTS

| | | | | |
|---|---|---|---|---|
| 3,312,566 A | * | 4/1967 | Winzeler | 427/449 |
| 4,970,091 A | * | 11/1990 | Buhrmaster et al. | 427/192 |
| 5,109,150 A | | 4/1992 | Rogers | |
| 5,808,270 A | * | 9/1998 | Marantz et al. | 219/121.47 |

FOREIGN PATENT DOCUMENTS

| | | |
|---|---|---|
| DE | 2 002 472 | 7/1971 |
| DE | 44 09 002 A1 | 9/1994 |
| EP | 0 839 924 A1 | 10/1997 |
| GB | 989027 | 5/1964 |
| GB | 1 350 168 | 4/1974 |
| GB | 1 357 582 | 6/1994 |

* cited by examiner

*Primary Examiner*—Katherine A. Bareford
(74) *Attorney, Agent, or Firm*—Jacobson Holman PLLC

(57) ABSTRACT

The method for thermal spraying, especially of metals, for the coating of surfaces, wherein the material employed for coating is supplied in the form of a wire, molten and sprayed, uses a plasma arc.

9 Claims, 2 Drawing Sheets

METHOD AND DEVICE FOR THERMAL SPRAYING FOR THE COATING OF SURFACES

This is a continuation of application Ser. No. 09/807,979 filed Apr. 30, 2001, now abandoned which is a 371 of PCT/EP 99/08247 filed Oct. 29, 1999.

The present invention is related to a method and a device for thermal spraying, especially of metals, for the coating of surfaces, wherein the material employed for coating is supplied in the form of a wire, molten and sprayed.

Devices of this kind are known in different designs. Thus, for example, manually operated spray guns are known in which two wires are mutually approached at an angle by feeding means in front of an atomizing gas nozzle, wherein an arc melting the wire material is produced between the wire ends.

It is also known to produce a melting flame within the spraying head by means of which the material to be sprayed is molten, wherein the molten particles are then transported by compressed air or the like onto the surface to be coated. Merely in an illustrative manner for arc technology, EP-0 239 585 B with further references may be mentioned.

The object of the invention has been to provide a method and a device for the spraying of metallic wire wherein at least one of the electrodes is not destroyed. A high efficiency, a low noise level and easy handling are to be ensured.

According to the invention, with the method and the device of the kind mentioned above, this object is achieved by producing the melting energy by a plasma arc, wherein the arc is formed between a non-melting stationary electrode and a melting electrode in the form of the wire, and the molten material is sprayed in the direction of wire feeding.

Torch heads with a plasma arc are as such known as cutting heads to be employed for the cutting of metal sheets and operated with compressed air. In this arc plasma cutting, the heat energy and the kinetic energy of an ionized gas column (plasma) are utilized to melt the metal and displace it from the cutting gap. This property is utilized by the invention in that the plasma arc is a compressed-air plasma arc, and a wire for atomizing is fed to such a plasma cutting head. Preferably, the arc is formed between a non-melting stationary electrode and a melting wire. The molten material is sprayed in the direction of wire feeding. The plasma arc is first ignited between the two electrodes. An electrically conductive wire takes the function of an electrode. After ignition, the wire, which is consuming away, is advanced accordingly.

Further embodiments of the invention can be seen from the dependent claims; in particular, as mentioned above, the torch head may be designed as a compressed-air plasma arc torch. Conveniently, the feeding nozzle for the wire with the atomizing gas is arranged at an angle with the center line of the plasma torch; for example, in a further embodiment, this angle between the wire feed and the plasma torch center line is about 75°.

Conveniently, the centric wire feed is surrounded by the atomizing gas nozzle in an annular arrangement.

It may be advantageous when an inert gas plasma torch is associated with the atomizing gas nozzle, and/or that a non-metallic wire can be associated with the atomizing gas nozzle for melting and spraying.

A particular advantage of the invention resides in the fact, inter alia, that a higher melting rate can be accomplished; the application efficiency can be increased by at least 10%, dust formation and evaporation of material being reduced.

In a further embodiment, depending on the application of the device according to the invention, at least two torch heads with associated wire feeding and atomizing gas nozzles may be provided. In this case, it is possible to supply different materials to the different torch heads and then to apply the mixture of materials to the surface to be coated.

Further details, advantages and features of the invention are seen from the following description and drawing.

Figure 1:
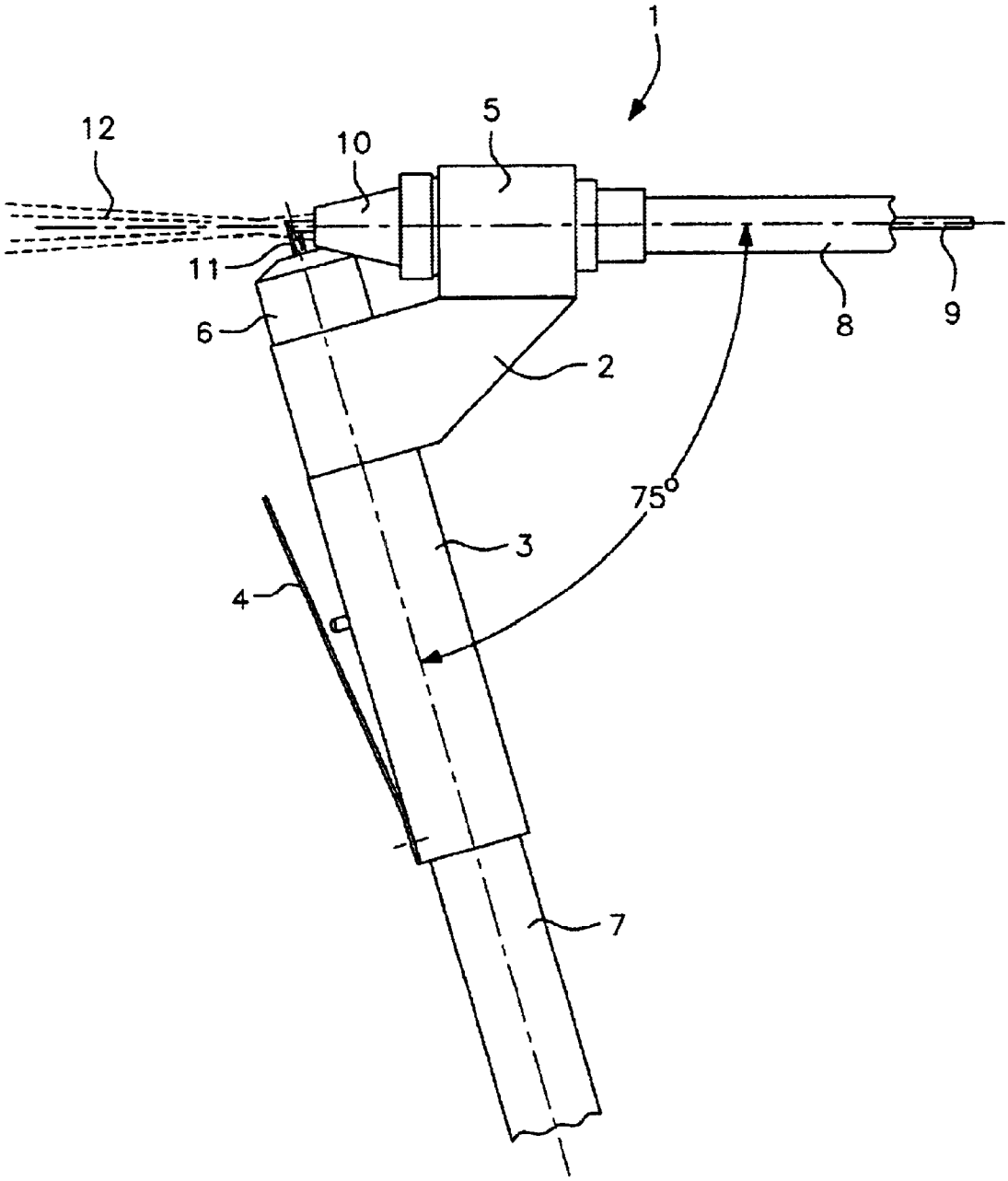
FIG. 1 shows a simplified reproduction of a device according to the invention.

The device, generally indicated by 1, consists of a spray gun housing 2 with a handle 3 designed as an actuating switch 4, wherein a spray wire supply head 5 and a compressed-air plasma torch head 6 whose center lines form an angle of 75° in the example represented here are associated with the housing 2. A merely outlined bundle of flexible tubes 7 with electric power supply and compressed air supply is associated with the plasma torch head 6, while a flexible supply tube 8 for the wire 9 is associated with the wire supply head. The compressed air is supplied via the housing 2, as can be seen, in particular, from FIG. 2.

The wire 9 exits from the front of the atomizing gas nozzle 10 and is molten in a plasma arc 11 and projected as, a spray jet 12 onto a non-represented surface by means of the atomizing gas.

Figure 2:
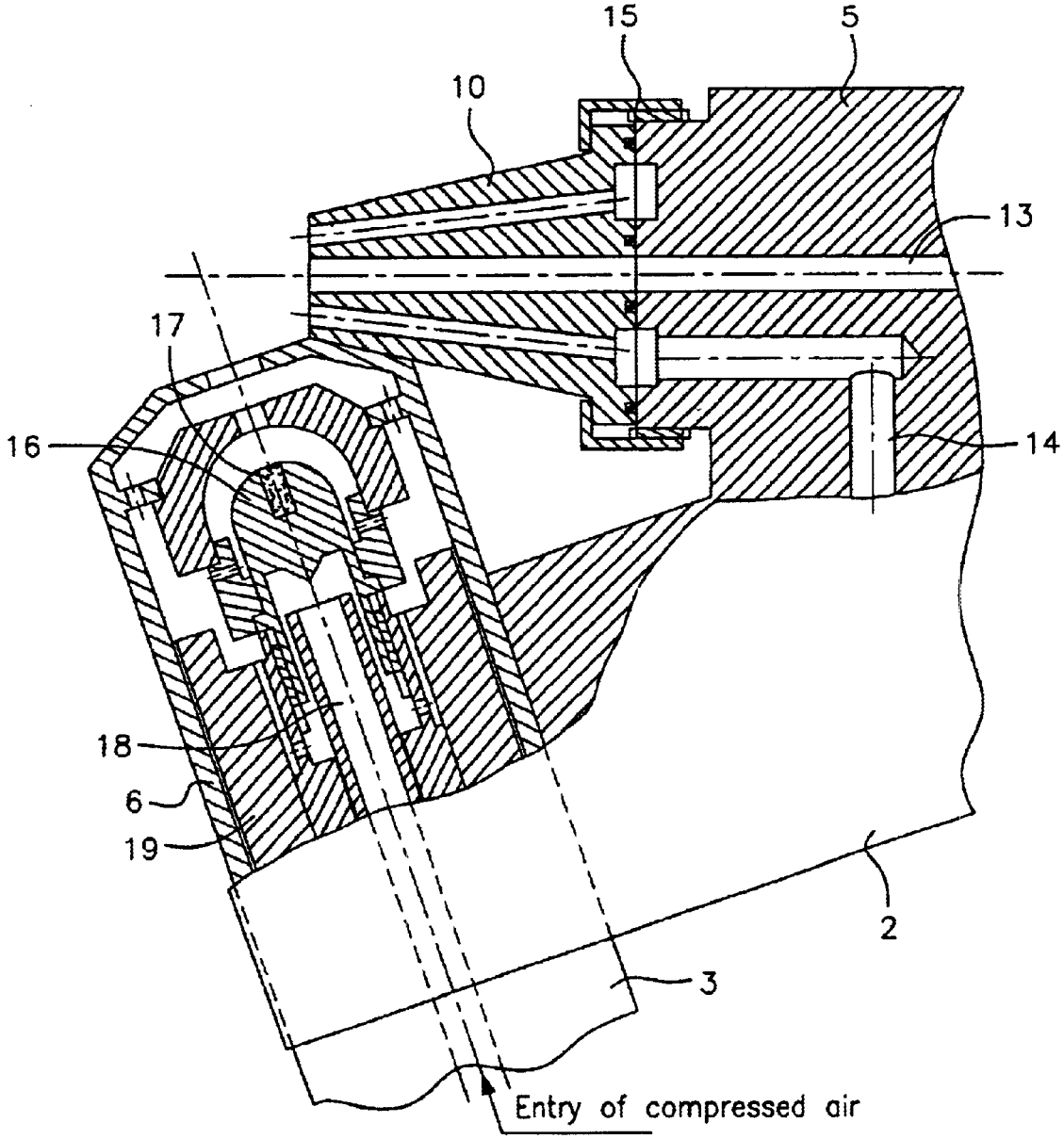
FIG. 2 shows an enlarged sectional representation of the head design of the device according to the invention.

In FIG. 2, the wire to be molten is not itself represented, but only a wire duct 13 is shown which is centrically passing through the atomizing gas nozzle 10. The atomizing gas is supplied through the housing 2 via corresponding ducts 14 to a ring chamber 15, which in turn surrounds the duct 13 for the wire in an essentially centric arrangement. Inside the plasma torch head 6, an electrode 16 with a Zr/Hf insert 17 is provided, and in this case too, a centric compressed air supply 18 is provided which is surrounded by insulating members 19.

Not represented in detail are controlling means which provide for that, for example, the compressed air supply rate for the plasma torch 6 and the compressed air supply rate for the formation of the atomizing gas jet can be set differently.

Of course, the described example of the invention can be modified in various ways without deviating from the basic idea. Thus, the arc can be produced not only between the torch as a cathode and, for example, the spray wire as an anode, as represented in the Figure, but it can also be produced within the torch between a cathode and an anode, so that electrically non-conducting wires, for example, plastic-sheathed oxide powder fill wires, can also be processed. This embodiment renders the device more flexible in the processing of various materials.

What is claimed is:

1. A method for thermal spraying of metals for coating a surface, wherein the metal for coating is fed in the form of a wire, the wire is melted to form molten metal, and the molten metal is sprayed using atomizing gas from a nozzle, characterized in that (a) the wire is melted by a compressed-air or inert-gas plasma arc, wherein the plasma arc is formed between a non-melting stationary electrode and a melting electrode formed by the wire, and (b) the molten metal is sprayed by the atomizing gas in a stream in the direction the wire is fed, wherein the wire is surround by the atomizing gas in an annular arrangement, and wherein the gas supply rate for the plasma arc and the gas supply rate for the formation of the atomizing gas are set differently.

2. The method according to claim 1, characterized in that said atomizing gas is an inert gas or compressed air.

3. The method according to claim 1, characterized in that the non-melting stationary electrode of the plasma arc has a center line and the wire is fed at a settable angle with the center line.

4. The method according to claim 3, characterized in that the angle between the wire and the center line is about 75°.

5. A device for thermal spraying a metal for coating a surface comprising:

a) a spray gun housing, b) a spray wire supply head connected to said housing, c) a plasma torch connected to said housing, d) a nozzle for spraying molten metal using an atomizing gas connected to said spray wire supply head, wherein said nozzle has a wire supply duct for feeding a metal wire, wherein the wire supply duct centrally passes through the nozzle such that the nozzle annularly surrounds the wire supply duct and the atomizing gas is supplied to the nozzle so that it exits surrounding the wire supply duct, e) said plasma torch having a torch head for melting the wire by producing with the wire a compressed-air or inert-gas plasma arc, and f) means for setting differently the supply rate of compressed-air or inert-gas for said plasma torch and the supply rate of compressed-air or inert-gas of the atomizing gas jet.

6. The device according to claim 5, characterized in that the wire supply duct is arranged at a settable angle to a center line of the plasma torch.

7. The device according to claim 6, characterized in that the angle is about 75°.

8. The device according to claim 5, further comprising a second nozzle for a wire of non-metallic material associated with the nozzle for melting and spraying the non-metallic material.

9. The device according to claim 5, characterized in that there are at least two nozzles, each with a wire supply duct for feeding wire to a different torch head associated with each nozzle.

* * * * *